US009991577B2

(12) United States Patent
Chun et al.

(10) Patent No.: US 9,991,577 B2
(45) Date of Patent: Jun. 5, 2018

(54) CAVITY FILTER USING CROSS-COUPLING

(71) Applicant: ACE TECHNOLOGIES CORPORATION, Incheon (KR)

(72) Inventors: Dong-Wan Chun, Incheon (KR); Jae-Ok Seo, Incheon (KR)

(73) Assignee: ACE TECHNOLOGIES CORPORATION, Incheon (KR)

( * ) Notice: Subject to any disclaimer, the term of this patent is extended or adjusted under 35 U.S.C. 154(b) by 97 days.

(21) Appl. No.: 15/096,124

(22) Filed: Apr. 11, 2016

(65) Prior Publication Data

US 2016/0301122 A1 Oct. 13, 2016

(30) Foreign Application Priority Data

Apr. 13, 2015 (KR) ..... 10-2015-0051724

(51) Int. Cl.
*H01P 1/208* (2006.01)
*H01P 1/205* (2006.01)

(52) U.S. Cl.
CPC ..... *H01P 1/2084* (2013.01); *H01P 1/205* (2013.01); *H01P 1/208* (2013.01)

(58) Field of Classification Search
CPC ..... H01P 1/202; H01P 1/205; H01P 1/20327; H01P 1/20336; H01P 1/2053; H01P 1/208
USPC ..... 333/202, 212, 206, 207
See application file for complete search history.

(56) References Cited

U.S. PATENT DOCUMENTS 5,608,363 A * 3/1997 Cameron ..... H01P 1/2084 333/202
6,239,673 B1 * 5/2001 Wenzel ..... H01P 1/2084 333/202
9,287,600 B2 * 3/2016 Cao ..... H01P 1/208

FOREIGN PATENT DOCUMENTS

| | | | |
|---|---|---|---|
| JP | 2000-114809 | A | 4/2000 |
| JP | 2001-185906 | A | 7/2001 |
| JP | 2001-267808 | A | 9/2001 |
| JP | 2010-226469 | A | 10/2010 |
| KR | 10-1028459 | B | 4/2001 |
| KR | 10-2009-0098822 | A | 9/2009 |
| KR | 10-2012-0129248 | A | 11/2012 |

* cited by examiner

*Primary Examiner* — Stephen E Jones
(74) *Attorney, Agent, or Firm* — Innovation Law LLP

(57) ABSTRACT

A cavity filter that uses cross-coupling is disclosed, which includes: a housing, in which multiple cavities are formed, with the cavities being open towards a first direction; multiple resonators held respectively in the multiple cavities; and a coupling member arranged to pass through an aperture between a first cavity and a second cavity, from among the multiple cavities, such that the coupling member is positioned between a first resonator and a second resonator. Here, the coupling member includes a first extending portion and a second extending portion, the first extending portion is positioned closer to the first resonator than to the second resonator and extends towards one side of the housing along the first direction, and the second extending portion is positioned closer to the second resonator than to the first resonator and extends towards the other side of the housing along the first direction.

7 Claims, 5 Drawing Sheets

CAVITY FILTER USING CROSS-COUPLING

CROSS-REFERENCE TO RELATED APPLICATIONS

This application claims the benefit of Korean Patent Application No. 10-2015-0051724, filed with the Korean Intellectual Property Office on Apr. 13, 2015, the disclosure of which is incorporated herein by reference in its entirety.

BACKGROUND

1. Technical Field

The present invention relates to an RF cavity filter, more particularly to a cavity filter that uses cross-coupling.

2. Description of the Related Art

A filter is a device that allows only signals of a specific frequency band to pass through. Depending on the band-pass property, a filter may be classified as a low-pass filter, a band-pass filter, a high-pass filter, a band-stop filter, etc. Also, depending on the structure of the filter, a filter may be classified as a lumped circuit filter, a ceramic filter, a cavity filter, etc.

A filter may filter signals of a particular frequency by using resonance obtained by a combination of inductances and capacitances, and the band-pass properties may be determined based on the manner in which the inductances and capacitances are connected.

Two important characteristics are associated with the filter; one is insertion loss, and the other is its skirt property. Insertion loss refers to how much of the total inputted power is lost, while the skirt property refers to how steep the band-pass property curve is. The insertion loss and the skirt property are mainly related to the order of the filter, and form a trade-off relationship with each other, as a higher order of the filter would result in better skirt property but worse insertion loss.

A base station of a mobile communication system frequently uses the cavity filter, in which multiple cavities are formed and a resonator is held in each of the cavities to provide the required band-pass property and delay.

With technological advances in the field of RF filters, there is a growing demand from base station service providers for filters having compact sizes. There are various approaches towards implementing smaller filters. In the case of the macrocell filter, there is active research under way focusing on the TM mode filter, which is relatively easy to implement in a thinner form. In the case of the small cell filter, providing a compact size may be a more important factor, and small coaxial resonators utilizing a ceramic material can be used.

A similarity between these two types of technology is in the resonance mode. At the head portion of a coaxial resonator employing a ceramic material, the E-field includes a longitudinal component that is stronger than the transverse component, in contrast to the existing TEM mode, so that a Quasi-TM mode field distribution is obtained that is similar to a TM mode.

Generally, controlling the transmission zero is critically important in improving the attenuation properties of a BPF, and this is implemented by applying cross-coupling between non-adjacent resonators. While inductive cross-coupling can be implemented with the use of an aperture or window between two resonators, capacitive cross-coupling may require an additional structure such as a coupling member to implement negative coupling. A coupling member refers to a structure that provides gap coupling for the transverse direction E-field of the two resonators to increase the capacitance value.

However, in the case of the TM mode for TM mode resonators and in the case of the Quasi-TM mode for resonators employing a ceramic material, the longitudinal direction E-field component is stronger than the transverse direction E-field component, so that there is a limit to implementing capacitive cross-coupling by using a coupling member that requires a transverse direction E-field component.

SUMMARY OF THE INVENTION

An aspect of the invention is to provide a cavity filter and a coupling member that can provide a large amount of capacitive cross-coupling between resonators, even while having a compact structure.

Another aspect of the invention is to provide a cavity filter and a coupling member that allow easy assembly, even while providing a large amount of capacitive cross-coupling between two resonators.

One embodiment of the invention provides a cavity filter that includes: a housing, in which a multiple number of cavities are formed, with the cavities being open towards a first direction; a multiple number of resonators held respectively in the multiple number of cavities; and a coupling member arranged to pass through an aperture between a first cavity and a second cavity, from among the multiple number of cavities, such that the coupling member is positioned between a first resonator held in the first cavity and a second resonator held in the second cavity. Here, the coupling member includes a first extending portion and a second extending portion, the first extending portion is positioned closer to the first resonator than to the second resonator and extends towards one side of the housing as viewed with respect to the first direction, and the second extending portion is positioned closer to the second resonator than to the first resonator and extends towards the other side of the housing opposite the one side of the housing as viewed with respect to the first direction.

According to an embodiment of the invention, the first extending portion can include a vertical support portion that extends along a direction facing the second resonator. In this case, the first extending portion can include a horizontal support portion that extends from the vertical support portion. The horizontal support portion can extend along a second direction that corresponds to the widthwise direction of the aperture.

Even in cases where the first extending portion does not include a vertical support portion, the first extending portion can include a horizontal support portion that extends along a second direction that corresponds to the widthwise direction of the aperture.

According to an embodiment of the invention, the first extending portion can include a first horizontal support portion that extends along the second direction, and the second extending portion can include a second horizontal support portion that extends along the second direction, where the first horizontal support portion and the second horizontal support portion can extend in opposite directions.

At least one of the first horizontal support portion and the second horizontal support portion can be joined to one side or the other side of the housing as viewed with respect to the first direction.

At least one of the first horizontal support portion and the second horizontal support portion can be joined to one side or the other side of the housing as viewed with respect to the second direction.

The housing can include an indentation subsided to hold the horizontal support portion or a post protruding to support the horizontal support portion, where the indentation or the post can be formed on one side or the other side of the housing as viewed with respect to the second direction According to an embodiment of the invention, the first extending portion can include a first vertical support portion that extends along a direction facing the second resonator, and the second extending portion can include a second vertical support portion that extends along a direction facing the first resonator. In this case, the first vertical support portion can be joined to one side of the aperture as viewed with respect to the first direction, and the second vertical support portion can be joined to the other side of the aperture as viewed with respect to the first direction.

The cavity filter can further include a cover that may be joined to the housing from the first direction, and in this case, the coupling member can have one end joined to the cover.

Another aspect of the invention provides a coupling member for a cavity filter that includes a housing, in which a multiple number of cavities are formed that open towards a first direction, and a multiple number of resonators, which are held respectively in the plurality of cavities. The coupling member includes a first extending portion and a second extending portion, where the first extending portion is positioned closer to a first resonator than to a second resonator from among the multiple number of resonators and extends towards one side of the housing as viewed with respect to the first direction, and the second extending portion is positioned closer to the second resonator than to the first resonator and extends towards the other side of the housing opposite the one side of the housing as viewed with respect to the first direction. Also, the coupling member is arranged to pass through an aperture between a first cavity holding the first resonator and a second cavity holding the second resonator, from among the multiple number of cavities, such that the coupling member is positioned between the first resonator held in the first cavity and the second resonator held in the second cavity.

Certain embodiments of the invention provide a cavity filter and a coupling member that can provide a large amount of capacitive cross-coupling between resonators while maintaining a compact structure.

Also, certain embodiments of the invention provide a cavity filter and a coupling member that can provide a large amount of capacitive cross-coupling between two resonators while allowing easy assembly.

Additional aspects and advantages of the present invention will be set forth in part in the description which follows, and in part will be obvious from the description, or may be learned by practice of the invention.

DETAILED DESCRIPTION OF THE INVENTION

Figure 1:
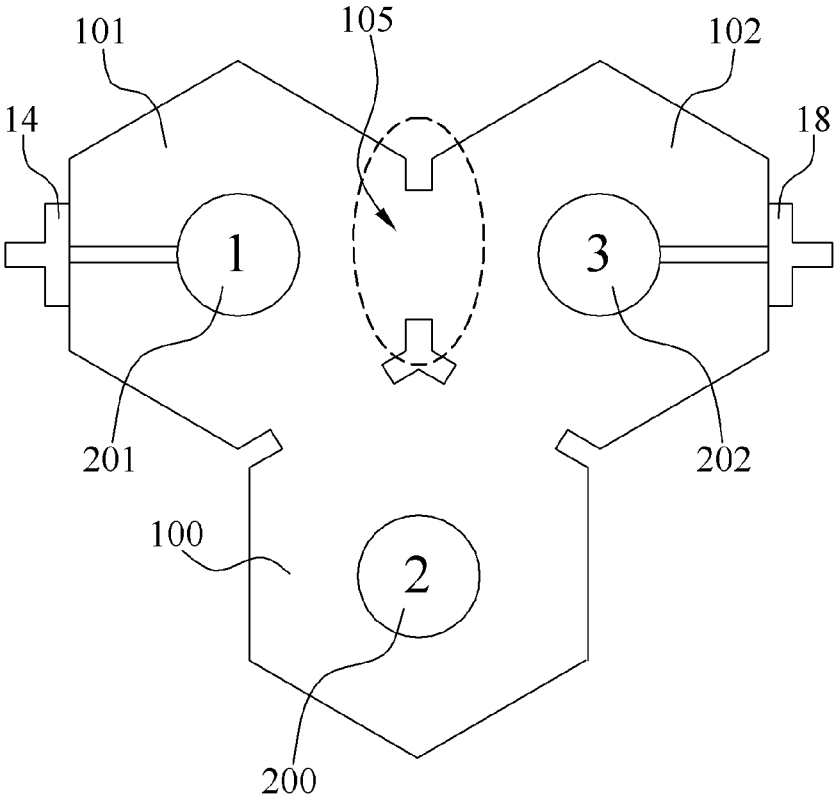
FIG. 1 is a plan view that conceptually illustrates a 3-pole cavity filter to which a coupling member for cross-coupling according to an embodiment of the invention can be applied.

As the invention allows for various changes and numerous embodiments, particular embodiments will be illustrated in the drawings and described in detail in the written description. However, this is not intended to limit the present invention to particular modes of practice, and it is to be appreciated that all changes, equivalents, and substitutes that do not depart from the spirit and technical scope of the present invention are encompassed in the present invention. In describing the drawings, like reference numerals are used for like elements.

While such terms as "first" and "second," etc., may be used to describe various components, such components must not be limited to the above terms. The above terms are used only to distinguish one component from another. For example, a first component may be referred to as a second component without departing from the scope of rights of the present invention, and likewise a second component may be referred to as a first component. Certain embodiments of the invention will be described below in more detail with reference to the accompanying drawings.

FIG. 1 is a plan view that conceptually illustrates a 3-pole cavity filter to which a coupling member for cross-coupling according to an embodiment of the invention can be applied.

Although only the cavities 100 are expressed in FIG. 1, it should be apparent to the skilled person that these cavities 100 are formed within a housing 10 which defines the cavities 100.

The housing 10 may serve as the main body of the filter, and a multiple number of cavities 100 can be formed inside the housing 10. While FIG. 1 illustrates an example in which three cavities 100 are formed, the number of cavities 100 can be changed as necessary. A resonator 200 can be installed in each of the cavities 100.

The housing 10 can be fabricated with an aluminum material as a base and with a silver plating applied thereto. The silver plating can be applied to obtain a high electrical conductivity, and other than silver plating, a housing 10 treated with copper plating can also be used.

The housing 10 can be open in a first direction, so that each of the cavities 100 can be open in said first direction. This would make it easier to install the resonators 200, the coupling member 300, etc., in the respective cavities 100.

From the first direction, the direction in which the housing 10 is open, a cover 50 can be joined to the housing 10.

The cover 50 can be joined onto the open side of the housing 10, for instance the upper part of the housing 10, so that the housing 10 may form an enclosed structure. By applying the cover 50, the inside of the filter can be shielded from electromagnetic waves. The cover 50 can also be fabricated by forming a base with aluminum and applying a silver plating treatment on the base structure.

The joining of the cover 50 and housing 10 can be achieved using any of a variety of methods. For example, the cover 50 can be joined to the housing 10 by way of a number of bolts, or can be joined to the housing 10 by way of soldering.

According to an embodiment of the invention, each of the resonators 200 can be made of a dielectric material, for example a ceramic material. When resonators 200 of a dielectric material are held within the cavities 100, the resonance within each of the cavities 100 can be achieved in the TM mode.

A resonator 200 can be shaped as a cylinder, with a depression or a hole formed in at least a portion of the cylinder. Of course, resonators shaped as a disc can also be used as necessary, and other dielectric resonators of various known shapes can also be applied to an embodiment of the invention. The resonator 200 can be joined to the bottom part of a cavity 100 by using a bolt, etc.

Of course, it is also possible to form the resonators 200 from various materials other than dielectric materials. For instance, a resonator 200 can be implemented as a coaxial resonator having a ceramic head joined to the top.

FIG. 1 conceptually illustrates a 3-pole filter structure that employs cross-coupling. Providing a transmission zero at the upper side of the passband can be achieved by applying inductive cross-coupling between resonator 201 and resonator 202, and this can be implemented by way of an aperture or a window. Providing a transmission zero at the lower side of the passband can be achieved by applying capacitive cross-coupling between resonator 201 and resonator 202, and this can be implemented by way of a coupling member, etc.

Figure 2:
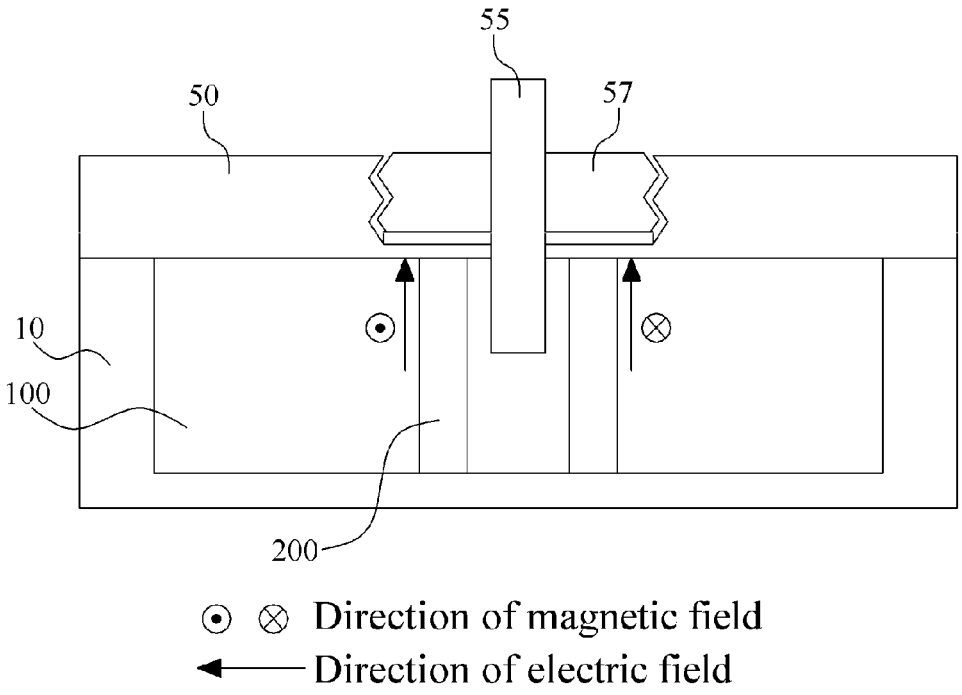
FIG. 2 is a cross-sectional view that conceptually illustrates the E-field and H-field distribution in one of the cavities of a cavity filter according to an embodiment of the invention.
Figure 3:
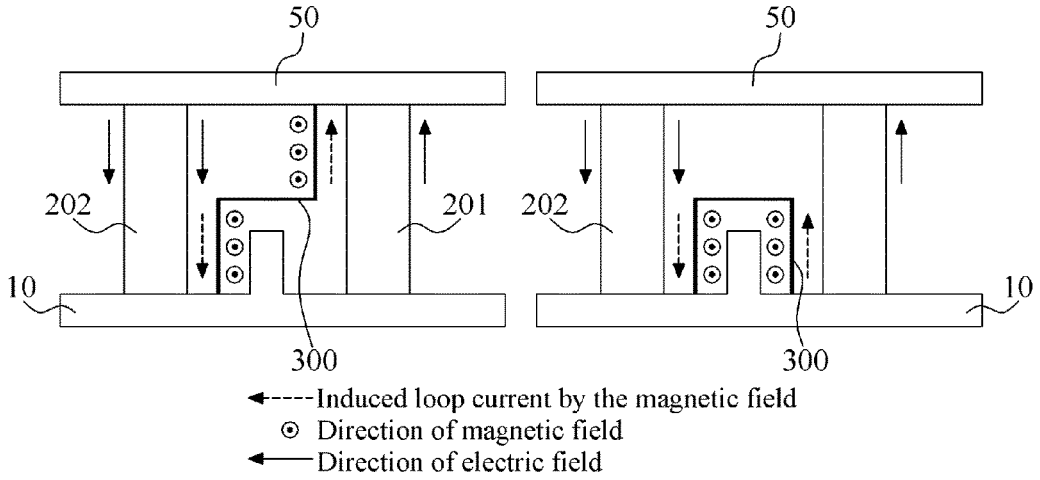
FIG. 3 is a cross-sectional view that conceptually illustrates a coupling member that is applicable to a cavity filter according to an embodiment of the invention and the resulting E-field and H-field distribution.

FIG. 2 is a cross-sectional view that conceptually illustrates the E-field and H-field distribution in one of the cavities of a cavity filter according to an embodiment of the invention, and FIG. 3 is a cross-sectional view that conceptually illustrates a coupling member that is applicable to a cavity filter according to an embodiment of the invention and the resulting E-field and H-field distribution.

As described above, a resonator 200 can have a cylindrical shape, and a tuning bolt 55 for tuning the filter's properties can be provided, with the tuning bolt 55 joined onto the cover 50 and inserted into the cavity 100. The tuning bolt 55 can also be inserted inside the cylindrical space of the resonator 200, as in the example shown in FIG. 2.

The housing 10 and cover 50 of the filter are at ground potential, and in order to obtain the desired electrical properties and securely join the resonators 200, it may be necessary to have the resonators 200 placed in tight contact against the cover 50. As such, a pressing member 57, etc., can also be included that provides a pressure for achieving such tight contact.

Referring to FIG. 2, at the upper part of the resonator 200, the longitudinal E-field component can be stronger than the transverse E-field component, thereby limiting the implementation of capacitive coupling. However, if a coupling member 30, 300 is used between the first resonator 201 and the second resonator 202 as in FIG. 3, a strong cross-coupling can be implemented.

FIG. 3 expresses the E-field, H-field, and induced current distribution according to the coupling loop type applied between TM mode resonators. In the case of the drawing on the right side of FIG. 3, the directions of the currents induced by the resonators are the same, meaning that the coupling is positive (+) and is thus inductive coupling. In the case of the drawing on the left side of FIG. 3, the coupling member is connected to a bottom surface of a cavity 100 and a top surface of a cavity 100 (i.e. to a bottom surface of the housing 10 and a lower surface of the cover 50), and it can be seen that the currents induced by the resonators have different directions. The coupling here is negative (−) and is thus capacitive coupling. That is, it is possible to implement capacitive coupling by utilizing a coupling of the H-field instead of using gap coupling of the E-field by way of a coupling member as in the related art. Such mechanism can also be applied to coaxial resonators having ceramic heads.

FIG. 4A through FIG. 4D conceptually illustrate a cavity filter and a coupling member according to an embodiment of the invention.

In the example shown on the left side of FIG. 3, the coupling member 300 may be connected to the bottom surface of a cavity 100 and the top surface of a cavity 100. In cases where the cavity filter is composed of a housing 10 and a cover 50 joined together, it may not be easy to join the coupling member 300, which has a relatively small thickness, onto the cover 50 in a stable fashion, and it can also be difficult to align the coupling member 300 in its proper position. On the other hand, in a structure that does not use a cover 50 so that the top surface of the cavities 100 cannot be removed, installing the coupling member 300 in the cavities 100 can itself be a lot of hassle.

Taking this into account, an embodiment of the invention can have the coupling member 300 structured such that the process of joining the coupling member 300 with the housing 10 and cover 50 can be performed easily.

Figure 4A:
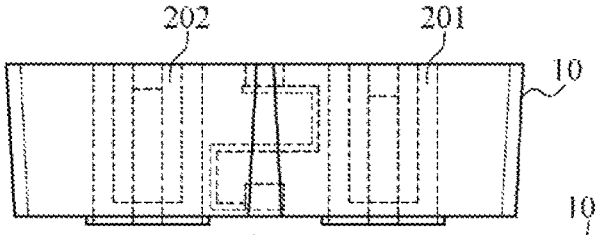
FIG. 4A is a cross-sectional view that conceptually illustrates a cavity filter according to an embodiment of the invention.
Figure 4B:
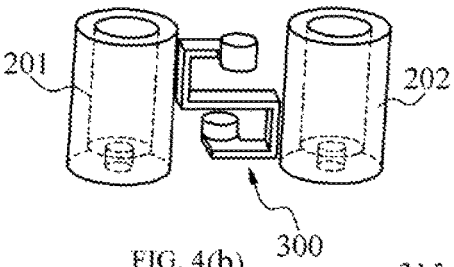
FIG. 4B is a perspective view that conceptually illustrates a coupling member positioned between first and second resonators according to an embodiment of the invention.
Figure 4:
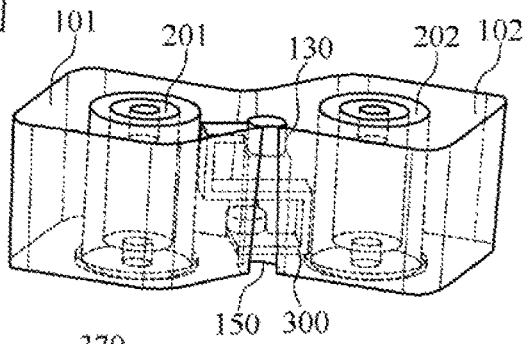
FIG. 4C is a perspective view that conceptually illustrates one way in which a coupling member may be positioned according to an embodiment of the invention.
FIG. 4D is a perspective view that conceptually illustrates a coupling member according to an embodiment of the invention.
Figure 4D:
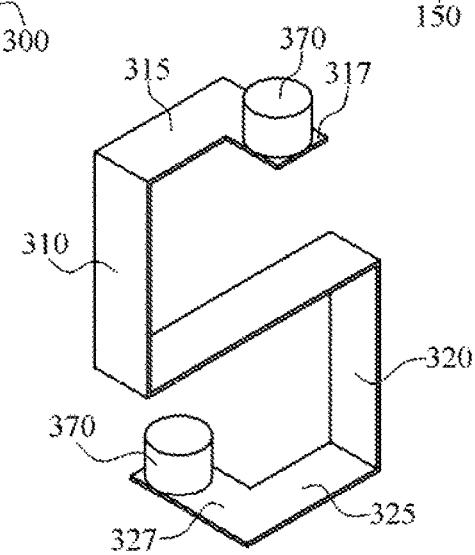

FIG. 4A is a cross-sectional view conceptually illustrating a cavity filter according to an embodiment of the invention, but with the cover 50 omitted. FIG. 4B is a perspective view conceptually illustrating a coupling member 300 positioned between a first resonator 201 and a second resonator 202, between which cross-coupling is to be implemented. FIG. 4C is a perspective view conceptually illustrating one way in which the coupling member 300 may be positioned in relation to the first cavity 101 holding the first resonator 201 and the second cavity 102 holding the second resonator 202, and FIG. 4D is a perspective view showing a closer view of the coupling member 300.

Referring to FIG. 4A through FIG. 4D, the coupling member 300 can include a first extending portion 310 that is positioned close to the first resonator 201, a second extending portion 320 that is positioned close to the second resonator 202, and a middle support portion 350 that connects the first extending portion 310 with the second extending portion 320.

As illustrated in FIGS. 4A to 4D, the first extending portion 310 can extend from a position adjacent to the first resonator 201 along the first direction towards one side of the housing 10 (the upper part of the housing 10), and the first extending portion 310 can include a first vertical support portion 315, which extends from the end of the first extending portion 310 back towards the second resonator 202.

Similarly, the second extending portion 320 can extend from a position adjacent to the second resonator 202 along the first direction towards the other side of the housing 10 (the lower part of the housing 10), and the second extending portion 320 can include a second vertical support portion 325, which extends from the end of the second extending portion 320 back towards the first resonator 202. Consequently, the coupling member 300 can have a shape that is similar to the letter "S".

In the present specification, the terms "first direction", "second direction", and "third direction" are used for the sake of convenience. The first direction refers to the direction in which each of the cavities 100 are open, including the first cavity 101 and second cavity 102, when the cover 50 is not mounted on the housing 10, and thus the first direction is a direction corresponding to the lengthwise direction of the first and second resonators 201, 202 as well as the lengthwise direction of the aperture 105 interposed between the first resonator 201 and the second resonator 202. The second direction refers to the direction corresponding to the widthwise direction of the aperture 105. The third direction refers to the direction of the second resonator 202 from the first resonator 201. The first direction, second direction, and third direction can be orthogonal to one another but are not limited thus.

If the coupling member 300 is made to have a particular width, the coupling member 300 can be arranged in a more stable manner if the first and second vertical support portions 315, 325 are provided. The first and second vertical support portions 315, 325 can be arranged to pass through the aperture 105 that is between the first and second resonators 201, 202. Within the housing 10, the first and second vertical support portions 315, 325 can contact the bottom surface of the housing 10 and the lower surface of the cover 50. This may allow the coupling member 300 to be structurally more stable and may also allow the coupling member 300 to maintain a more stable electrical connection with the housing 10.

The first and second vertical support portions 315, 325 can extend up to the same length, as in the example illustrated in FIG. 4A. In an embodiment that does not include horizontal support portions 317, 327, which are described later on, the fastening parts 370 formed on these first and second vertical support portions 315, 325 can be positioned in a line along the first direction. Of course, the invention is not limited thus; it is possible to have the lengths of the first and second vertical support portions 315, 325 be longer or shorter, it is possible to make the lengths of the first and second vertical support portions 315, 325 different from each other, and it is also possible to provide a vertical support portion on just one of the first extending portion 310 and second extending portion 320.

The first extending portion 310 can also include a first horizontal support portion 317 that extends along the second direction from the first vertical support portion 315. Similarly, the second extending portion 320 can include a second horizontal support portion 327 that extends along the second direction from the second vertical support portion 325. The first and second horizontal support portions 317, 327 can not only increase the contact area between the coupling member 300 and the housing 10 to increase the area by which the coupling member 300 is supported, but can also support the coupling member 300 along the horizontal direction (second direction), so that the coupling member 300 may stand in a structurally stable manner.

In cases where both the first extending portion 310 and the second extending portion 320 include horizontal support portions 317, 327 as in the example illustrated in FIGS. 4A to 4D, the first horizontal support portion 317 and the second horizontal support portion 327 can extend in opposite directions. Having the first and second horizontal support portions 317, 327 extend in opposite directions would make the process of applying the fastening part 370 during assembly much easier.

In the housing 10, a holding space 130 can be formed to hold the first horizontal support portion 317. Referring to FIG. 4C, at the position corresponding to the aperture 105, a post 150 protrudes inward from one side of the housing 10. At the upper part of the post 150, a holding space 130 can be formed in which the first horizontal support portion 317 and a fastening part 370 applied thereto may be positioned. That is, the post 150 may extend from the bottom surface of the housing 10 in the first direction at the position of the aperture 105, but without reaching the top surface of the housing 10 so as to form the holding space 130. The illustration in FIG. 4C has the housing 10 omitted and expresses only the cavities 101, 102, and as such, the post 150 is represented as an empty space, but in an actual implementation, the post 150 can be filled in with the material of the housing 10 or can have a hollow interior.

The height of the holding space 130, i.e. the height from the top surface of the post 150 up to the lower surface of the cover 50, can correspond to the thickness of the first horizontal support portion 317 held in the holding space 130 and the height of the fastening part 370 for securing the first horizontal support portion 317 to the top surface of the post 150. The fastening part 370 for securing the first horizontal support portion 317 that is inserted into the holding space 130 can be implemented in the form of a bolt, rivet, screw, or the like. The fastening part 370 can be made of a conductive material so that an electrical connection is obtained between the coupling member 300 and the housing 10 and/or between the coupling member 300 and the cover 50.

With this arrangement, the coupling member 300 can be joined to the top surface of the post 150 instead of the cover 50 itself, and later when the cover 50 is joined to the housing 10, a stable electrical contact can be achieved between the cover 50 and the coupling member 300. Of course, the first horizontal support portion 317 of the coupling member 300 can also be made to join with the cover 50 while merely placed on the upper surface of the post 150 in the holding space 130. That is, the fastening part 370 can be implemented in the form of a bolt or a screw, etc., which passes through a hole (not shown) in the cover 50 to secure the first horizontal support portion 317.

The holding space 130 formed in the housing 10 can also be implemented without using a post 150 that protrudes inward. For example, the holding space 130 can also be implemented in the form of an indentation (not shown) formed in the inner wall of the housing 10. Also, the fastening part 370 for securing the first horizontal support portion 317 inserted into the holding space 130 can be implemented in any of a variety of sizes and shapes using a bolt, rivet, screw, or the like.

In the example illustrated in FIG. 4D, the first horizontal support portion 317 may be held in the holding space 130 formed over the post 150, while the second horizontal support portion 327 may be joined to the bottom surface of the housing 10 without being held in a separate holding space. This is because it may not be easy to the joining of the coupling member 300 at the upper part of the housing 10 where the cover 50 will be joined, whereas it would not be difficult to join the coupling member 300 at the lower part of the housing 10.

Of course, it is also possible to form a holding space in the housing 10 for the second horizontal support portion 327. For example, posts 150 protruding inward can be formed on both sides of the housing 10 at the position of the aperture 105, with the post 150 on one side extending from the bottom surface of the housing 10 to a position short of the top surface of the housing 10 and with the post 150 on the other side extending from the top surface of the housing 10 to a position short of the bottom surface of the housing 10, so that the first horizontal support portion 317 can be held in the holding space 130 on one side, and the second horizontal support portion 327 can be held in the holding space on the other side.

In another example, a post 150 protruding inward at the position of the aperture 105 can be made to have holding spaces formed in both the upper part and the lower part, and the first horizontal support portion 317 and the second horizontal support portion 327 can extend in the same direction to held in the holding spaces at the upper part and lower part of the post 150. In this case, the fastening part 370 for securing the second horizontal support portion 327 that is inserted in the holding space at the lower part of the post 150 can be implemented in the form of a bolt or screw, etc., which passes through a hole (not shown) formed in the bottom surface of the housing 10 and secures the first horizontal support portion 317.

The fastening part 370 need not be limited to a particular shape as long as it can secure the first horizontal support portion 317 or second horizontal support portion 327 of the coupling member 300 and maintain electrical contact between the coupling member 300 and the housing 10. The fastening part 370 can be a separate part as in FIGS. 4A to 4D, or can be a part of the coupling member 300.

By way of the fastening part 370, at least one of the first horizontal support portion 317 and the second horizontal support portion 327 can be joined to one side or the other side of the housing 10 as viewed with respect to the first direction. In another example, at least one of the first horizontal support portion 317 and the second horizontal support portion 327 can be joined to one side or the other side of the housing 10 as viewed with respect to the second direction. According to the positions at which the coupling member 300 is joined to the housing 10, the end portions of the coupling member 300 can be bent parallel to the inner surface of the housing 10.

As mentioned above, it may be easier, in terms of mounting the coupling member 300, if the first horizontal support portion 317 and second horizontal support portion 327 are joined at different positions with respect to the second direction.

In an embodiment of the invention that is not depicted in an illustration, the coupling member 300 may be formed with at least one of the first and second horizontal support portions 317, 327 omitted. For example, the coupling member 300 can include only the first horizontal support portion 317 such that only one end of the coupling member 300 is held in the holding space 130, while the other end of the coupling member 300 can be formed such that the second vertical support portion 325 is joined directly to the bottom surface of the housing 10.

Furthermore, it is also possible to form the coupling member 300 with the first horizontal support portion 317 omitted. For example, in the open surface of the housing 10, a structure such as a beam can be provided at a position corresponding to the aperture 105, so that the upper part of the aperture 105 is completely defined by the housing 10 itself, and the first vertical support portion 315 of the coupling member 300 can be joined to said beam (not shown).

Moreover, in another embodiment of the invention that is not depicted in an illustration, the coupling member 300 can be formed with at least one of the first and second vertical support portions 315, 325 omitted. That is, the first extending portion 310 can continue directly to the first horizontal support portion 317 from the end of the portion that extends parallel to the first resonator 201, and likewise, the second extending portion 320 can continue directly to the second horizontal support portion 327 from the end of the portion that extends parallel to the second resonator 202.

According to the embodiments of the invention described above, a large amount of capacitive cross-coupling can be obtained between two resonators 201, 202 that are held in two adjacent cavities 101, 102 where cross-coupling is desired, by providing a coupling member 300 between the resonators 201, 202. A cavity filter with such a composition can be easily implemented in a compact size and can provide the desired amount of cross-coupling.

In particular, the structure has an open side in the housing 10 that can be closed by way of a cover 50 mounted onto the housing 10. This allows easy manufacture and assembly of the cavity filter, and furthermore allows a structurally and electrically stable mounting of the coupling member 300, whereby the cavity filter can maintain high reliability.

Figure 5:
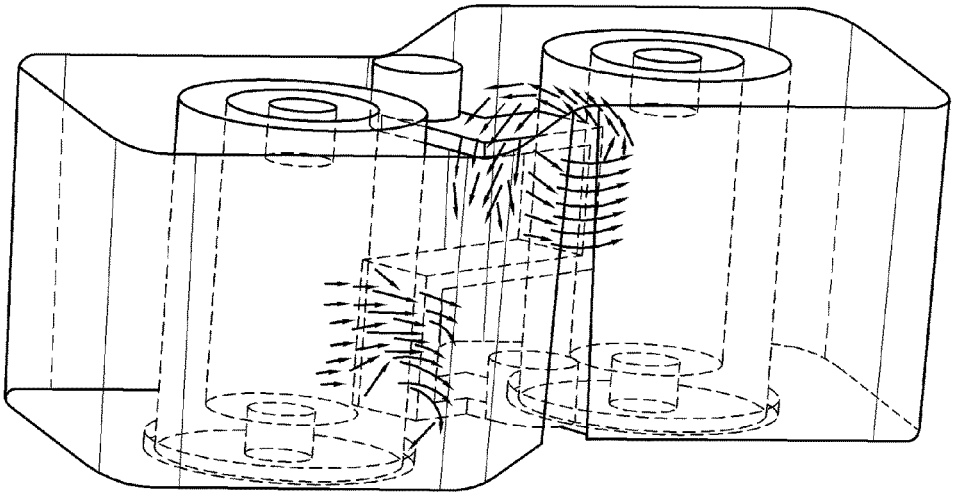
FIG. 5 conceptually illustrates the H-field distribution in the cavity filter illustrated in FIG. 4C.
Figure 6:
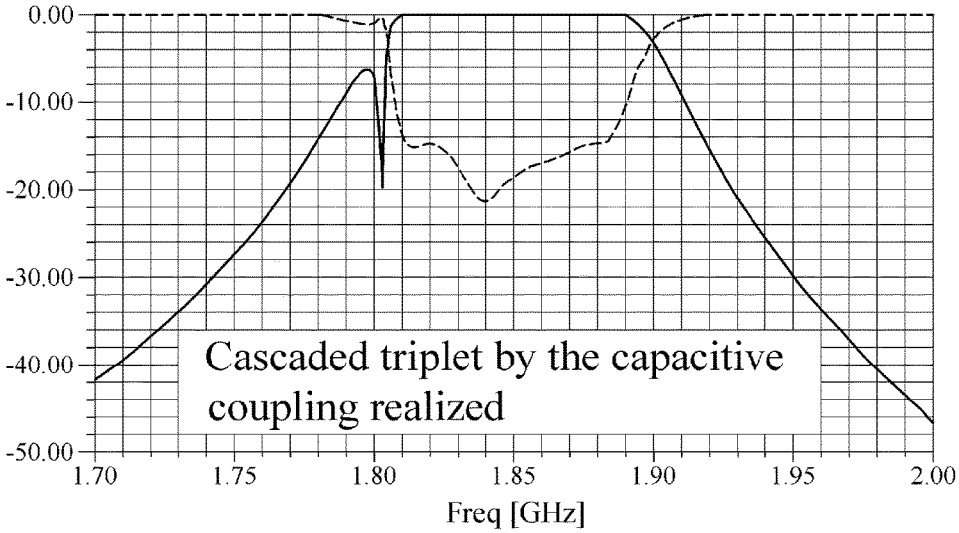
FIG. 6 is a graph representing the BPF properties obtained by a cavity filter according to an embodiment of the invention.

FIG. 5 conceptually illustrates the H-field distribution in the cavity filter illustrated in FIG. 4C, and FIG. 6 is a graph representing the BPF properties obtained by a cavity filter according to an embodiment of the invention.

Referring to FIG. 5, it can be seen that the H-field is coupled in the predicted direction. The directions of the currents induced in the resonators are opposite to each other, meaning that a negative coupling is obtained. Referring to FIG. 6, it can be seen that the transmission zero has been implemented very close to the lower side of the passband in a cavity filter based on an embodiment of the invention due to capacitive cross-coupling.

While the present invention has been described above using particular examples, including specific elements, by way of limited embodiments and drawings, it is to be appreciated that these are provided merely to aid the overall understanding of the present invention, the present invention is not to be limited to the embodiments above, and various modifications and alterations can be made from the disclosures above by a person having ordinary skill in the technical field to which the present invention pertains. Therefore, the spirit of the present invention must not be limited to the embodiments described herein, and the scope of the present invention must be regarded as encompassing not only the claims set forth below, but also their equivalents and variations.

While the present invention has been described above using particular examples, including specific elements, by way of limited embodiments and drawings, it is to be appreciated that these are provided merely to aid the overall understanding of the present invention, the present invention is not to be limited to the embodiments above, and various modifications and alterations can be made from the disclosures above by a person having ordinary skill in the technical field to which the present invention pertains. Therefore, the spirit of the present invention must not be limited to the embodiments described herein, and the scope of the present invention must be regarded as encompassing not only the claims set forth below, but also their equivalents and variations.

What is claimed is:

1. A cavity filter comprising:

a housing having a plurality of cavities formed therein, the cavities being open towards a first direction;

a plurality of resonators held respectively in the plurality of cavities; and a coupling member arranged to pass through an aperture between a first cavity and a second cavity of the plurality of cavities such that the coupling member is positioned between a first resonator held in the first cavity and a second resonator held in the second cavity, wherein the coupling member comprises a first extending portion and a second extending portion, the first extending portion is positioned closer to the first resonator than to the second resonator and extends towards one side of the housing as viewed with respect to the first direction, the second extending portion is positioned closer to the second resonator than to the first resonator and extends towards the other side of the housing opposite the one side of the housing as viewed with respect to the first direction;

wherein the first extending portion includes a vertical support portion and a horizontal support portion extending from the vertical support portion, the vertical support portion extending along a direction facing the second resonator and the horizontal support portion extending along a second direction corresponding to a widthwise direction of the aperture;

wherein the first extending portion includes a first horizontal support portion extending along the second direction, the second extending portion includes a second horizontal support portion extending along the second direction, and the first horizontal support portion and the second horizontal support portion extend in opposite directions; and wherein at least one of the first horizontal support portion and the second horizontal support portion is joined to the one side or the other side of the housing as viewed with respect to the first direction.

2. The cavity filter of claim 1, wherein at least one of the first horizontal support portion and the second horizontal support portion is joined to one side or the other side of the housing as viewed with respect to the second direction.

3. The cavity filter of claim 1, wherein the housing includes an indentation subsided to hold the horizontal support portion or a post protruding to support the horizontal support portion, the indentation or the post formed on one side or the other side of the housing as viewed with respect to the second direction.

4. The cavity filter of claim 1, wherein the first extending portion includes a first vertical support portion extending along a direction facing the second resonator, the second extending portion includes a second vertical support portion extending along a direction facing the first resonator, the first vertical support portion is joined to one side of the aperture as viewed with respect to the first direction, and the second vertical support portion is joined to the other side of the aperture as viewed with respect to the first direction.

5. The cavity filter of claim 1, further comprising a cover joined to the housing from the first direction, wherein the coupling member has one end thereof joined to the cover and the other end thereof joined to the housing.

6. A coupling member for a cavity filter, the cavity filter comprising a housing and a plurality of resonators, the housing having a plurality of cavities formed therein, the cavities being open towards a first direction, the plurality of resonators held respectively in the plurality of cavities, wherein the coupling member comprises a first extending portion and a second extending portion, the first extending portion is positioned closer to a first resonator than to a second resonator from among the plurality of resonators and extends towards one side of the housing as viewed with respect to the first direction, the second extending portion is positioned closer to the second resonator than to the first resonator and extends towards the other side of the housing opposite the one side of the housing as viewed with respect to the first direction, wherein the coupling member is arranged to pass through an aperture between a first cavity holding the first resonator and a second cavity holding the second resonator from among the plurality of cavities such that the coupling member is positioned between the first resonator held in the first cavity and the second resonator held in the second cavity; and wherein the housing includes an indentation subsided to hold the horizontal support portion or a post protruding to support the horizontal support portion, the indentation or the post formed on one side or the other side of the housing as viewed with respect to the second direction.

7. The cavity filter of claim 6, wherein the first extending portion includes a first horizontal support portion extending along the second direction, the second extending portion includes a second horizontal support portion extending along the second direction, and the first horizontal support portion and the second horizontal support portion extend in opposite directions.

* * * * *